US006589353B1

(12) United States Patent
Chen et al.

(10) Patent No.: US 6,589,353 B1
(45) Date of Patent: Jul. 8, 2003

(54) TREATMENT OF AIR-BEARING SURFACE OF A DISC DRIVE SLIDER WITH LIGHT AND OXIDIZING GAS

(75) Inventors: Ga-Lane Chen, Fremont, CA (US); Simon Wing-Tat Fung, Fremont, CA (US)

(73) Assignee: Seagate Technology LLC, Scotts Valley, CA (US)

( * ) Notice: Subject to any disclaimer, the term of this patent is extended or adjusted under 35 U.S.C. 154(b) by 0 days.

(21) Appl. No.: 09/578,301

(22) Filed: May 25, 2000

Related U.S. Application Data

(60) Provisional application No. 60/136,076, filed on May 26, 1999.

(51) Int. Cl.[7] ..... B08B 7/04

(52) U.S. Cl. ..... 134/1; 134/34; 134/37; 134/902

(58) Field of Search ..... 134/1, 2, 34, 37, 134/39, 40, 902; 360/234.3

(56) References Cited

U.S. PATENT DOCUMENTS

| | | | | |
|---|---|---|---|---|
| 4,756,047 | A | 7/1988 | Hayashi et al. | 15/306 B |
| 5,028,560 | A | 7/1991 | Tsukamoto et al. | 437/81 |
| 5,159,508 | A | 10/1992 | Grill et al. | 360/103 |
| 5,781,377 | A | 7/1998 | Koka et al. | 360/103 |
| 6,231,676 | B1 * | 5/2001 | Rudd et al. | 134/1 |

FOREIGN PATENT DOCUMENTS

| | | | |
|---|---|---|---|
| JP | 05-20655 | * | 1/1993 |

* cited by examiner

*Primary Examiner*—Alexander Markoff
(74) *Attorney, Agent, or Firm*—Westman, Champlin & Kelly, P.A.

(57) ABSTRACT

A method and apparatus for treating the air-bearing surface of a disc drive slider are disclosed. The surface is exposed to an oxidizing gas while being irradiated with light. In an illustrative embodiment, the oxidizing gas employed is ozone and the surface is irradiated with ultraviolet light.

8 Claims, 3 Drawing Sheets

TREATMENT OF AIR-BEARING SURFACE OF A DISC DRIVE SLIDER WITH LIGHT AND OXIDIZING GAS

CROSS-REFERENCE TO RELATED APPLICATION

This application claims the benefit of U.S. Provisional Patent Application No. 60/136,076 entitled "UOE ON SLIDER DLC TO REDUCE THERMAL ASPERITY, FLY HIT, CORROSION, AND ENHANCE HDI RELIABILITY," filed on May 26, 1999.

FIELD OF THE INVENTION

The present invention relates generally to disc drive data storage systems. More particularly, the present invention relates to the treatment of the air-bearing surface of a disc drive slider.

BACKGROUND OF THE INVENTION

A typical disc drive data storage system can include multiple magnetic discs mounted for rotation on a hub or spindle. A spindle motor causes the discs to spin and the surface of the discs to pass under respective head-gimbal assemblies. The head-gimbal assemblies carry transducers which write information to, and read information from the disc surfaces. An actuator mechanism moves the head-gimbal assemblies from track to track across surfaces of the discs under control of electronic circuitry. Read and write operations are performed through read and write transducers which are located at the trailing edge face of the slider. In some disc drives, the read transducer includes a magnetoresistive (MR) element whose resistance changes in response to the magnetic fields corresponding to the data stored on the adjacent magnetic disc. The slider and transducer are sometimes collectively referred to as a head, and typically a single head is associated with each disc surface. The heads are selectively moved under the control of electronic circuitry to any one of multiple circular, concentric data tracks on the corresponding disc surface by an actuator device.

Each slider body includes an air-bearing surface (ABS). As the disc rotates the disc drags air beneath the air-bearing surface, which develops a lifting force which causes the head to lift and fly several microinches above the disc surface. The air-bearing surface is typically covered with a protective coating such as diamond-like carbon (DLC). For example, see Grill et al. U.S. Pat. No. 5,159,508 entitled Magnetic Head Slider Having a Protective Coating Thereon." As is known in the art, this layer is provided to enhance the tribological performance of the head-disc interface (HDI). In addition, the DLC coating decreases the read/write transducer sensitivity to electrostatic damage and corrosion.

The head-disc interface design is critical to the reliability of magnetic disc drives, and to MR and GMR (giant MR) disc drives in particular. Asperities, nodules and debris are commonly removed from the surface of the discs through post-sputtering processes and buff/wipe/burnishprocesses. Buffing (tape burnishing) processes can be used to cut down on the nodule extrusions and the asperities. Wiping processes can be used to clean up the surface debris after buffing. The air-bearing surface of the slider may also contain particles, asperities, and debris thereon that may cause serious problems regarding thermal asperities and fly-height hits. Also, the MR element can be damaged by triboelectrical charges (electrostatic charges produced by friction). Furthermore, debris may accumulate in the air-bearing surface or pole-tips and cause poor mechanical integration and corrosion issues. However, because of the small size of the slider, it is not feasible to use conventional mechanical buff/ wipe/burnish processes on the air-bearing surface of the slider. Thus there is presently no post-coating treatment of the air-bearing surface after the DLC coating to remove the asperities, nodules and debris from the air-bearing surface.

The present invention provides a solution to this and other problems and offers other advantages over the prior art.

SUMMARY OF THE INVENTION

The present invention relates to the treatment of the air-bearing surface of a disc drive slider.

One embodiment of the present invention is directed to an apparatus for treating a surface of a disc drive slider. The apparatus includes means for irradiating the surface of the slider with light while exposing the surface to an oxidizing gas.

Another embodiment of the invention is directed to a method of treating a surface of a disc drive slider. Pursuant to the method, the surface of the slider is irradiated with light while exposing the surface to an oxidizing gas. In an illustrative embodiment, the oxidizing gas employed is ozone gas ($O_3$). In a further illustrative embodiment, ultraviolet (UV) light is used to irradiate the surface of the slider.

Another embodiment of the present invention is directed toward an apparatus for treating a surface of a disc drive slider. The apparatus includes a process chamber, an oxidizing-gas generator and a lamp. The process chamber is adapted to contain the slider. The oxidizing-gas generator is adapted to introduce oxidizing gas into the process chamber. The lamp is disposed in the process chamber and adapted to irradiate the surface of the slider with light. In an illustrative embodiment, the oxidizing-gas generator is an ozone generator and the lamp is a UV lamp.

These and various other features as well as advantages which characterize the present invention will be apparent upon reading of the following detailed description and review of the associated drawings.

DETAILED DESCRIPTION OF ILLUSTRATIVE EMBODIMENTS

Figure 1:
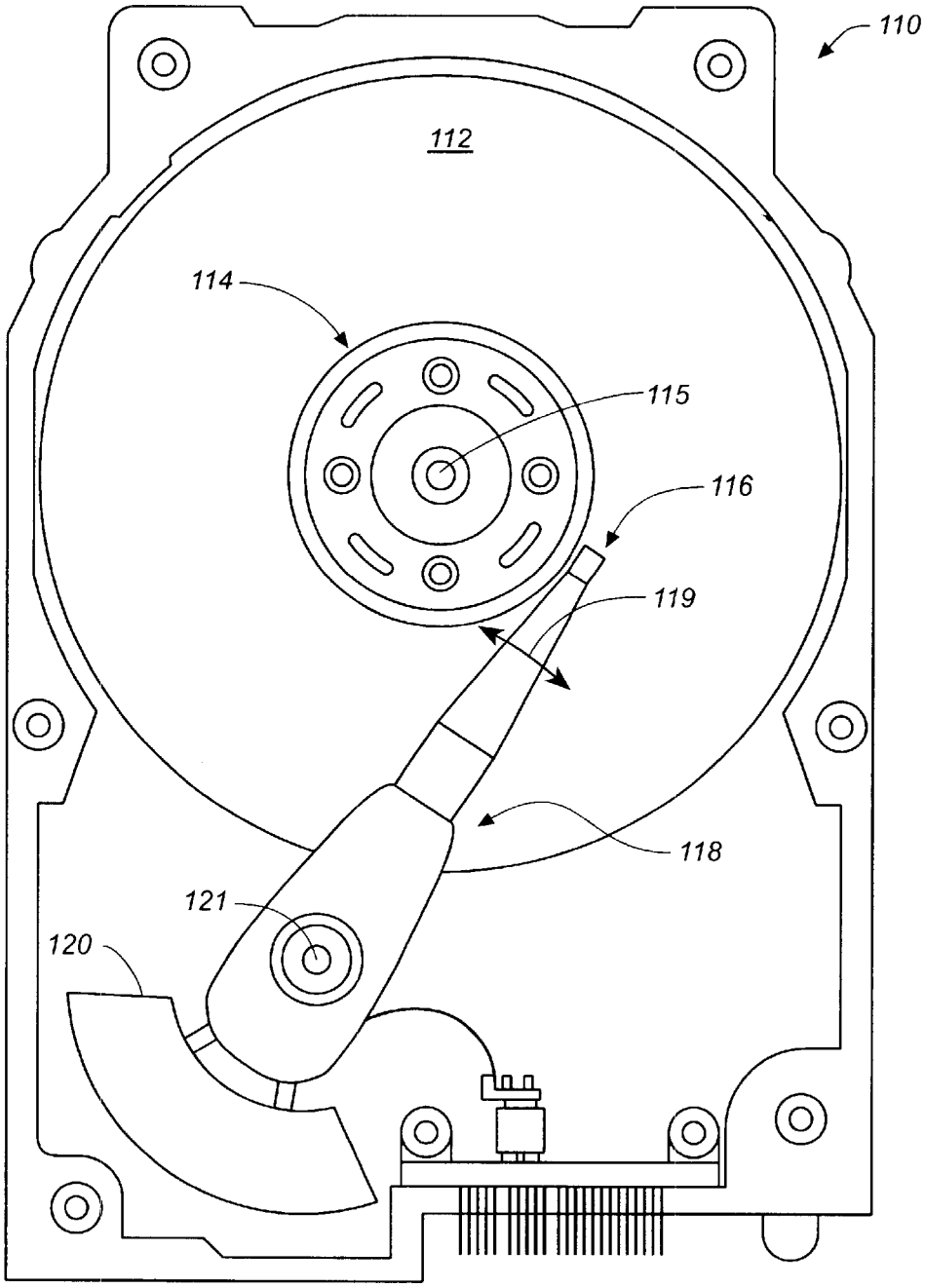
FIG. 1 is a plan view of a typical disc drive.

FIG. 1 is a plan view of a typical disc drive 110. Disc drive 110 includes a disc pack 112, which is mounted on a spindle motor (not shown) by a disc clamp 114. Disc pack 112, in one preferred embodiment, includes a plurality of individual discs which are mounted for co-rotation about a central axis 115. Each disc surface on which data is stored has an associated head-gimbal assembly (HGA) 116 which is mounted to an actuator assembly 118 in disc drive 110. The actuator assembly shown in FIG. 1 is of the type known as a rotary moving coil actuator and includes a voice coil motor shown generally at 120. Voice coil motor 120 rotates actuator assembly 118 with its attached head-gimbal assemblies 116 about a pivot axis 121 to position head-gimbal assemblies 116 over desired data tracks on the associated disc surfaces, under the control of electronic circuitry housed within disc drive 110.

More specifically, actuator assembly 118 pivots about axis 121 to rotate head-gimbal assemblies 116 generally along an arc 119 which causes each head-gimbal assembly 116 to be positioned over a desired one of the tracks on the surfaces of discs in disc pack 112. Head-gimbal assemblies 116 can be moved from tracks lying on the innermost radius, to tracks lying on the outermost radius of the discs. Each head-gimbal assembly 116 has a gimbal which resiliently supports a slider relative to a load beam so that the slider can follow the topography of the disc. The slider, in turn, includes one or more transducers, which are utilized for encoding flux reversals on,.and reading flux reversals from, the surface of the disc over which it is flying.

Figure 2:
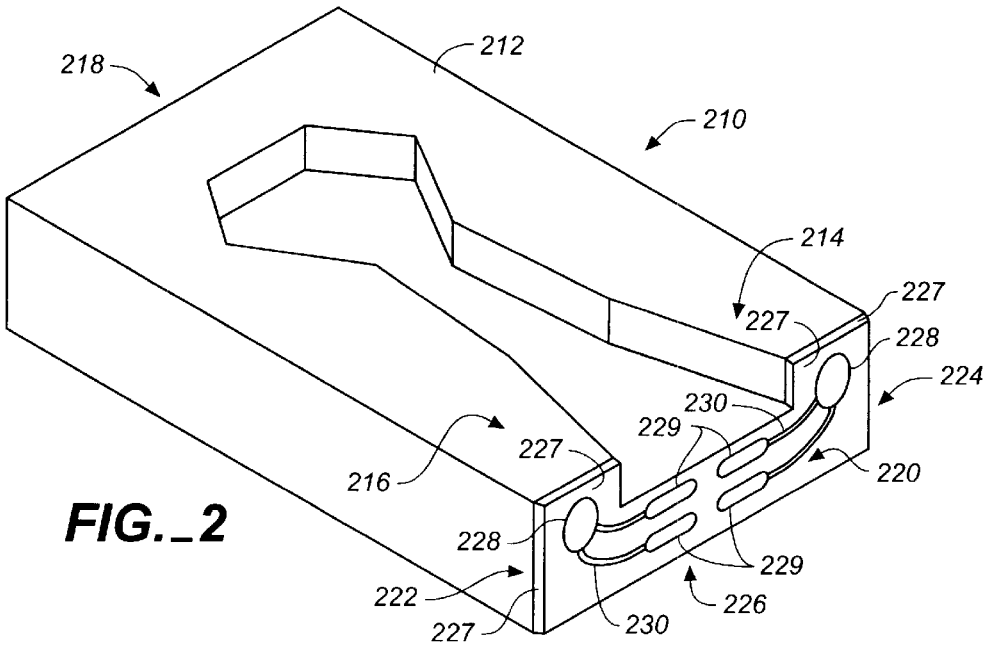
FIG. 2 is a diagrammatic bottom view in perspective of a slider suitable for treatment according to the present invention.
Figure 3:
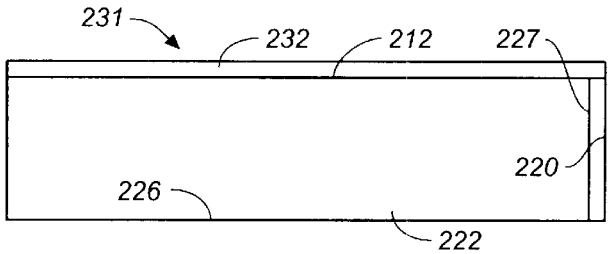
FIG. 3 is a diagrammatic upside-down side view of a slider suitable for treatment according to the present invention.

FIGS. 2 and 3 show a slider 210 of the type known in the art which carries magnetic data heads or transducers for use in a magnetic disc data storage system. FIG. 2 is a diagrammatic bottom view in perspective of slider 210. FIG. 3 is a diagrammatic upside-down side view of slider 210. FIG. 3 is illustrated as "upside-down" in order to correspond to the illustrated orientation of slider 210 shown in FIG. 2. Of course, sliders can operate in a variety of orientations so long as the air-bearing surface faces the surface of the corresponding magnetic disc. Slider 210 is intended to represent a generic slider design. The specific design features illustrated in FIGS. 2 and 3 are not intended to limit the scope of the invention in any way. Slider 210 includes bottom surface or air-bearing surface (ABS) 212, rails 214 and 216 make up part of air-bearing surface 212, leading edge face 218, trailing edge face 220, side edge faces 222 and 224, and top face or surface 226. Typically, air-bearing surface 212 is oriented substantially parallel to top surface 226, while faces or surfaces 218, 220, 222 and 224 are oriented substantially perpendicular to surfaces 212 and 226 to form a generally rectangular shaped slider. Air-bearing surface 212 of slider 210 faces the surface of a magnetic storage disc as slider 210 flies above the disc. Typically, the junction of trailing edge face 220 and ABS 212 is closest to the surface of the magnetic storage disc during operation.

Magnetic data heads or transducers 228 are located on trailing edge face 220 at positions corresponding to rails 214 and 216 of slider 210. Magnetic heads 228 can include inductive and/or magnetoresistive (MR) data heads. Although one of magnetic data heads 228 is illustrated as being located at each of rails 214 and 216, in preferred embodiments, slider 210 can include a single magnetic data head located at only one of rails 214 and 216. Alternatively, an inductive writer data head and an MR reader data head can be located adjacent one another at the trailing 25 edge end of one of rails 214 and 216. FIGS. 2 and 3 are intended to represent any and all of these common configurations. Magnetic data heads 228 are coupled to bond pads 229 through electrical connections 230. Typically, alumina 227 is used to encapsulate magnetic data heads 228 to maintain their structural integrity during the manufacturing processes and during use.

As is known in the art, slider 210 preferably includes a protective coating 232 on at least portions of air-bearing surface 212 to enhance the tribological performance of the slider/disc interface, and to decrease the read/write head or transducer sensitivity to electrostatic damage and corrosion. Alternatively stated, protective coating 232 becomes at least portions of the ABS. In an illustrative embodiment, protective coating 232 comprises diamond-like carbon (DLC).

Protective coating 232, as applied during the manufacture of slider 210, commonly has unwanted particles, asperities and debris thereon. Such irregularities decrease the tribological performance of the slider/disc interface. Also, irregularities on air-bearing surface 212 can be large enough to physically contact the disc as the disc rotates under the head. Such contact, while of very short time duration, can result in frictional heating of the MR element. The change of temperature brought about by the contact correspondingly produces a change in the resistance of the MR element. Such events are known as thermal asperities, and can significantly distort the readback signal generated by the head. A thermal asperity event is typically characterized by a sudden increase in read signal amplitude, followed by a relatively long falling edge due to the heat dissipation time constant of the MR head.

Contact with the disc can also result in triboelectrical charges that are damaging to the MR element. Furthermore, debris may accumulate in air-bearing surface 212 or pole-tips of transducers 228, causing poor mechanical integration as well as corrosion issues. Additionally,: contact between the disc and an irregularity on the slider may scratch the surface of the disc, inducing further corrosion issues. Such a scratch may allow $Co^{+2}$ ions to react with moisture to form $Co(OH)_2$ or $CoO_x$. The formation of corrosion spots can cause data loss, head crashes, and other severe reliability issues regarding the storage of data.

Figure 4:
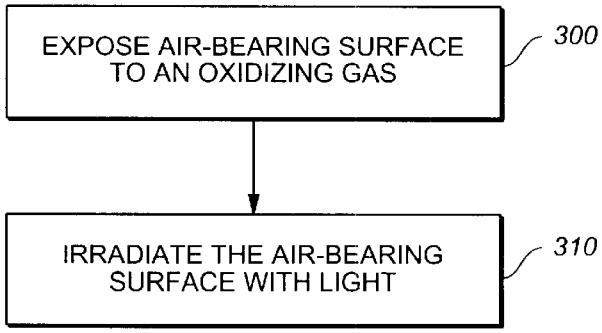
FIG. 4 is a flow chart representing a method of treating the air-bearing surface of a slider according to an illustrative embodiment of the present invention.

Due to the small size of slider 210, it is not feasible to remove the asperities on protective coating 232 with mechanical buff/wipe/burnish processes such as those employed to reduce the asperities on the surfaces of the discs. Therefore, the present invention discloses a non-contact method of reducing the particles, asperities and debris on the protective coating 232 of air-bearing surface 212. FIG. 4 is a flow chart representing a method of treating the air-bearing surface 212 of slider 210, according to an illustrative embodiment of the present invention. At step 300, the air-bearing surface 212 of the slider 210 is exposed to an oxidizing gas. At step 310, the air-bearing surface 212 is irradiated with light. In an illustrative embodiment, the oxidizing gas used is ozone ($O_3$) and the air-bearing surface is irradiated with ultraviolet (UV) light.

Figure 5:
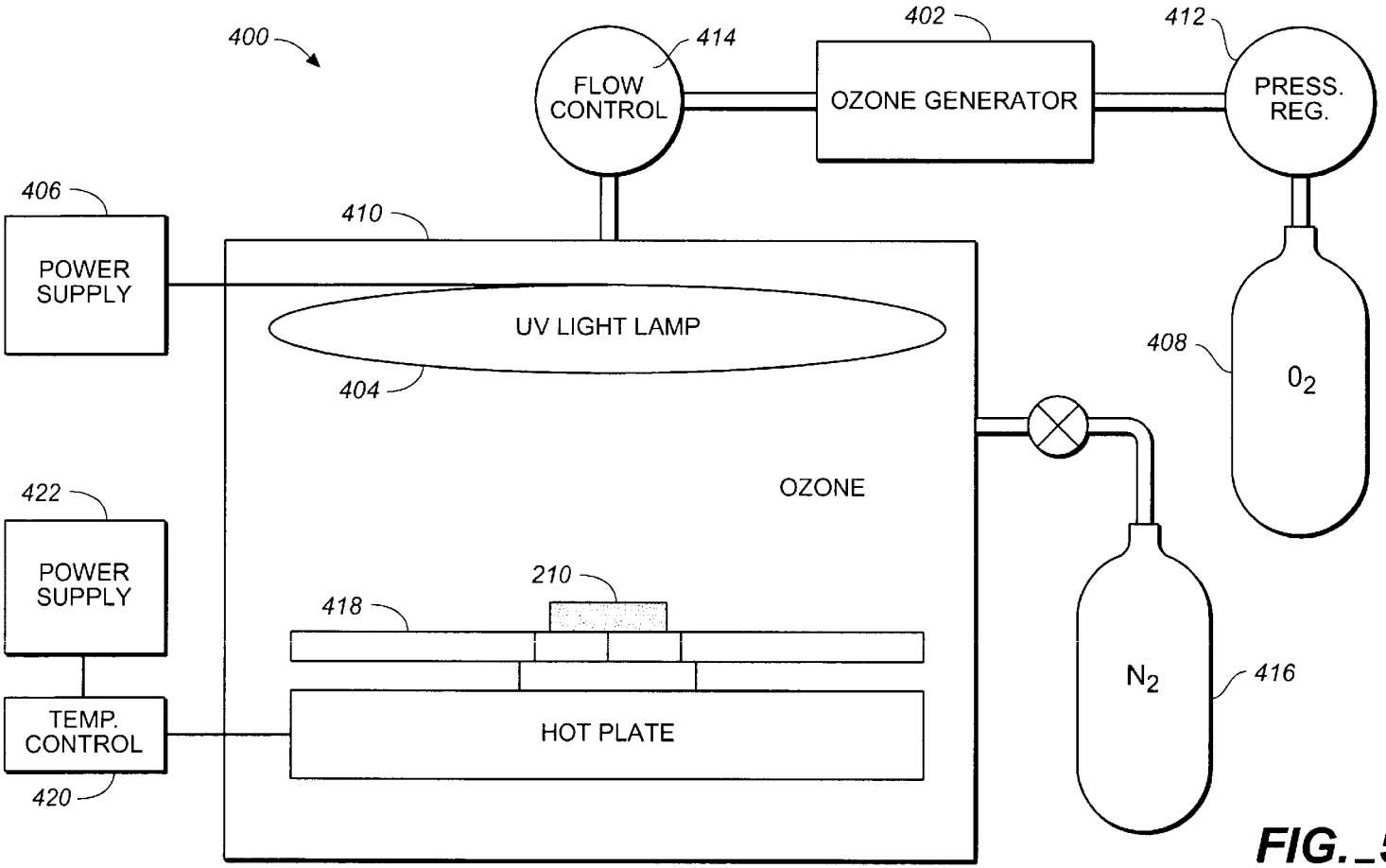
FIG. 5 is a functional block diagram representing an apparatus for treating an air-bearing surface of a slider according to an illustrative embodiment of the present invention.

FIG. 5 is a functional block diagram representing an apparatus 400 for treating an air-bearing surface of a slider 210 according to an illustrative embodiment of the present invention. The apparatus 400 includes a process chamber 410, an oxidizing-gas generator 402 and a lamp 404. The process chamber 410 is adapted to contain the slider 210. The oxidizing-gas generator 402 is adapted to generate an oxidizing gas and to introduce the oxidizing gas into the process chamber 410. In an illustrative embodiment, the oxidizing-gas generator 402 is an ozone generator. Lamp 404 is disposed in the process chamber and adapted to irradiate the surface of the slider 210 with light. In an illustrative embodiment, lamp 404 is a UV light lamp. Lamp 404 has an associated power supply 406 exterior to the process chamber 410.

In an illustrative embodiment, apparatus 400 includes oxygen gas tank 408 adapted to store substantially pure oxygen gas ($O_2$). Oxygen gas tank 408 supplies oxygen gas to oxidizing-gas generator 402 via pressure regulator 412. Oxidizing-gas generator 402 then uses this oxygen gas to generate an oxidizing gas such as ozone. Flow rate controller 414 controls the rate of flow of the oxidizing gas into process chamber 410. In an illustrative embodiment, flow rate controller 414 is a mass flow rate controller. In an illustrative embodiment, the flow rate of ozone gas into process chamber 410 is maintained between approximately 0.5 liters per minute and 1.0 liters per minute.

In an illustrative embodiment of the present invention, apparatus 400 further includes nitrogen gas tank 416. Nitrogen gas tank 416 stores substantially pure nitrogen gas ($N_2$). In an illustrative embodiment, after the process of UV photon-ozone etching disclosed by the present invention is finished, process chamber 410 is purged with the nitrogen gas from nitrogen gas tank 416 before venting process chamber 410.

In another illustrative embodiment of the present invention, hot plate 418 is provided within process chamber 410 to effect the temperature of slider 210 during treatment thereof. Hot plate 418 has an associated temperature controller 420 external to process chamber 410. Power supply 422 powers temperature controller 420. In an alternative embodiment, hot plate 418 is not included as part of treatment apparatus 400. In this case slider 210 is disposed on the floor of process chamber 410 or on a suitable support structure.

During the treatment of the air-bearing surface of slider 210, referred to herein as UV-ozone etching (UOE), slider 210 is oriented such that the air-bearing surface is facing lamp 404, so that it can readily receive the photons produced by lamp 404. The exposure to the UV light in the presence of an oxidizing gas causes a photo-chemical reaction on the air-bearing surface which results in a chemical oxidation process. This chemical oxidation process causes the decomposition of organic contaminants on the air-bearing surface. Thus, asperities, nodules, particles and debris are removed from the air-bearing surface, resulting in a clean surface. The minimizing of "dynamic particles" at the head-disc interface decreases the possibility of thermal asperities and MR element zapping (MR element electrical breakdown) during the operation of the disc drive. Thus a lower fly height is made possible. The reduction of irregularities on the air-bearing surface also lessens the possibility of corrosion occurring on the slider as well as on the associated disc.

At an ozone gas flow rate of 0.5 liters per minute and at a starting temperature of 22 C., the UV-ozone etching process of the present invention has been found to remove carbon surface debris after one minute of exposure to the ozone and the UV light.

The UV-ozone etching method of the present invention can also be used to decrease the thickness of the protective layer 232 of the air-bearing surface 212. It has been found that, at an ozone gas flow rate of 0.5 liters per minute and at a starting temperature of 22 C., approximately 3.3 Angstroms/minute of diamond-like carbon 232 are etched from the air-bearing surface 212. Thus to remove 10 Angstroms of DLC 232 from air-bearing surface 212, approximately three minutes of exposure to the ozone and UV light are required. Thus, protective layer 232 can be etched down to the desired thickness by the present invention.

In summary, one embodiment of the present invention is directed to an apparatus .400 for treating a surface of a disc drive slider. The apparatus includes means for irradiating the surface of the slider with light while exposing the surface to an oxidizing gas.

Another embodiment of the invention is directed to a method of treating a surface 212 of a disc drive slider 210. Pursuant to the method, the surface 212 of the slider 210 is irradiated with light while exposing the surface 212 to an oxidizing gas. In an illustrative embodiment, the oxidizing gas employed is ozone gas ($O_3$). In a further illustrative embodiment, ultraviolet (UV) light is used to irradiate the surface of the slider.

Another embodiment of the present invention is directed toward an apparatus 400 for treating a surface of a disc drive slider 210. The apparatus includes a process chamber 410, an oxidizing-gas generator 402 and a lamp 404. The process chamber 410 is adapted to contain the slider 210. The oxidizing-gas generator 402 is adapted to introduce oxidizing gas into the process chamber 410. The lamp 404 is disposed in the process chamber 410 and adapted to irradiate the surface of the slider 210 with light. In an illustrative embodiment, the oxidizing-gas generator 402 is an ozone generator and the lamp 404 is a UV lamp.

It is to be understood that even though numerous characteristics and advantages of various embodiments of the present invention have been set forth in the foregoing description, together with details of the structure and function of various embodiments of the invention, this disclosure is illustrative only, and changes may be made in details, especially in matters of structure and arrangement of parts within the principles of the present invention to the full extent indicated by the broad general meaning of the terms in which the appended claims are expressed. For example, although the invention is described herein as employing ozone as the oxidizing gas, other oxidizing gases, such as $N_2O$ of $NF_3$, may also be employed, without departing from the scope and spirit of the present invention. Other modifications can also be made.

What is claimed is:

1. A method of removing material from a protective coating that has been applied to a surface of a disc drive slider, the method comprising steps of:

disposing the slider in a process chamber;

exposing the protective coating to a controllable source of an oxidizing gas, wherein exposing comprises introducing the oxidizing gas into the process chamber; and irradiating the protective coating with a controllable source of light while exposing the protective coating to the oxidizing gas.

2. The method of claim 1 wherein the oxidizing gas is ozone.

3. The method of claim 1 wherein irradiating the protective coating comprises irradiating with ultraviolet light the surface of the slider to which the protective coating has been applied.

4. The method of claim 1 wherein the surface is an air-bearing surface of the slider.

5. The method of claim 1 wherein the oxidizing gas is introduced into the process chamber at a rate of flow maintained in a range from 0.5 liters per minute to 1.0 liters per minute.

6. The method of claim 1, wherein irradiating the protective coating comprises directing light from a lamp disposed in the process chamber toward the surface of the slider to which the protective coating has been applied.

7. The method of claim 1 wherein the protective coating comprises diamond-like carbon.

8. A slider treated in accordance with the method of claim 1.

* * * * *